United States Patent [19]

Koerner

[11] 4,015,264

[45] Mar. 29, 1977

[54] DUAL MODE BROADBAND ANTENNA

[75] Inventor: John A. Koerner, Belmont, Calif.

[73] Assignee: Textron, Inc., Belmont, Calif.

[22] Filed: Nov. 20, 1975

[21] Appl. No.: 633,632

[52] U.S. Cl. ..... 343/725; 343/895

[51] Int. Cl.[2] ..... H01Q 1/36

[58] Field of Search ..... 343/726, 727, 895, 725

[56] References Cited

UNITED STATES PATENTS

| | | | |
|---|---|---|---|
| 3,740,754 | 6/1973 | Epis | 343/789 |
| 3,820,117 | 6/1974 | Hall et al. | 343/895 |

*Primary Examiner*—Eli Lieberman

*Attorney, Agent, or Firm*—Gregg, Hendricson, Caplan & Becker

[57] ABSTRACT

A cavity-backed spiral antenna has a plurality of resistively loaded monopole radiators disposed in the cavity in orthogonal relation to the spiral windings to maximize the frequency range of the antenna without increasing the physical size thereof.

6 Claims, 4 Drawing Figures

DUAL MODE BROADBAND ANTENNA

BACKGROUND OF INVENTION

Spiral antennas that are equi-angular or are Archimedean spirals, are known to be highly useful in very high frequency applications. A planar spiral antenna, for example, has two branches lying in the same plane that are symmetrical with respect to a point and are in phase opposition to produce maximum radiation in two directions that are symmetrical with respect to the antenna plane. Such antennas are widely used in air-borne direction finding systems and commonly radiation in a single direction from such an antenna is obtained by backing the spiral with a coaxial cavity having a depth that is equal to one-quarter wavelength at average operating frequency of the antenna. This is intended to cause reflected radiation in the cavity and direct radiation in the same direction from the spiral to be in phase in the plane of the spiral to reinforce rather than interfere with radiation; however, the foregoing is only true over a limited frequency range.

In order to improve or extend the frequency range of spiral antennas, it is common to provide various types of cavity structures backing the spirals. As an example of the foregoing, reference is made to U.S. Pat. Nos. 3,192,531, 3,358,288, 3,441,937, 3,555,554 and 3,686,674.

The low frequency cutoff for a spiral antenna is a function of the spiral antenna size and it has been found that a 2½ inches diameter spiral antenna operates satisfactorily down to about 2 GHz. It would be desirable to extend the low frequency range, particularly for aircraft direction finding, without increasing the antenna size because of the difficulties in mounting larger sized antenna on aircraft structures. In order to extend the low frequency range down to 500 MHz, for example, it would normally be necessary to increase the antenna diameter to about 10 inches and in addition to the undesirability of this increase in size, added design problems are encountered, such as moding.

The present invention provides a second antenna inside of a spiral antenna cavity to materially extend the low frequency range of the antenna without increasing the size thereof.

SUMMARY OF INVENTION

The present invention provides a physically small dual mode broadband antenna, combining two antenna types in a single cavity with a minimum of electrical cross coupling and interference to materially increase the frequency range without increasing antenna size. A conventional planar spiral antenna is backed with a cylindrical cavity having the axis thereof normal to the plane of the spiral and preferably including RF absorbing material in the cavity. Also disposed in the cavity is a plurality of resistively loaded monopoles below and orthogonal to the spiral windings. With four monopoles disposed in 90° spacing in the cavity, the monopoles are energized with equal power and in phased progression of 0°, 90°, 180° and 270° to achieve circular polarization of the antenna. Energizing two monopoles with a power divider provides a linearly polarized antenna.

An antenna in accordance with the present invention, having a physical size of only 2.4 inches in diameter, has a frequency range from 500 MHz to 18 GHz as compared to a frequency range of 2 GHz to 18 GHz for a conventional spiral antenna of the same physical size.

DESCRIPTION OF FIGURES

The present invention is illustrated as to the particularly preferred embodiment thereof in the accompanying drawings wherein.

DESCRIPTION OF PREFERRED EMBODIMENT

Figure 1:
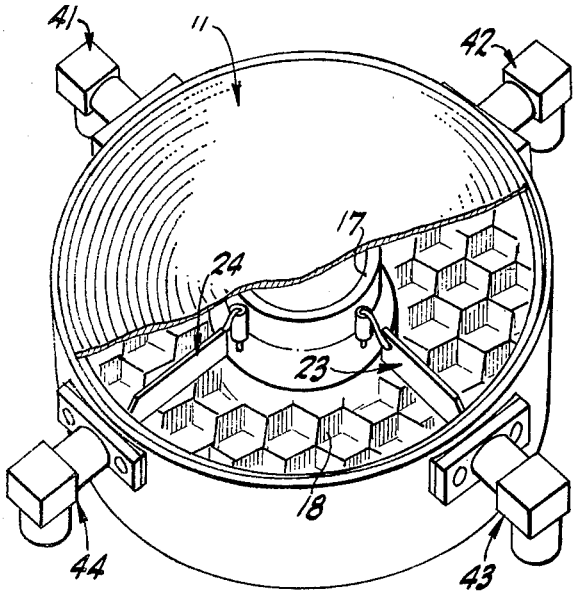
FIG. 1 is a perspective view of an antenna in accordance with the present invention and having portions broken away as illustrated.
Figure 2:
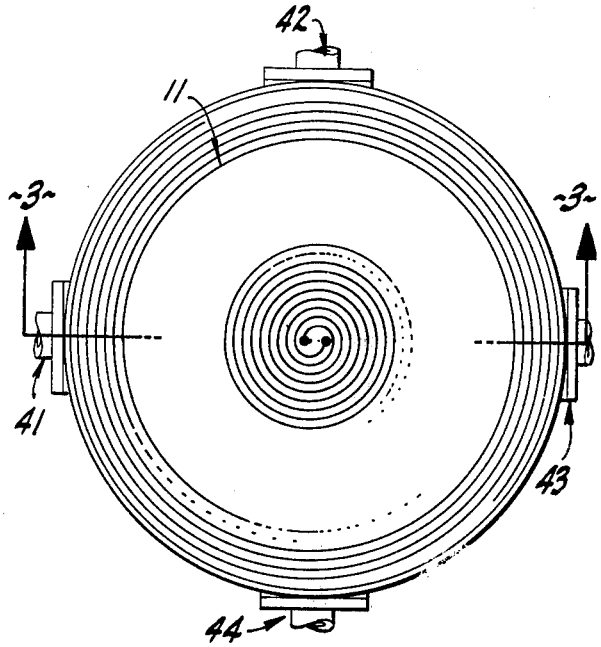
FIG. 2 is a front plan view of the antenna of FIG. 1.
Figure 3:
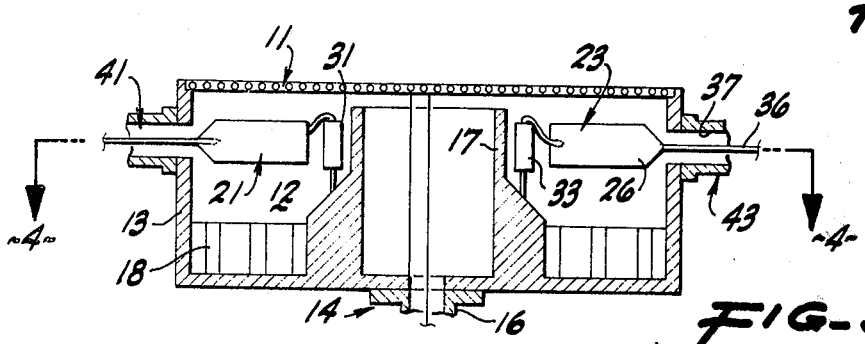
FIG. 3 is a central vertical sectional view taken in the plane 3—3 of FIG. 2.

Referring now to the drawings there will be seen to be illustrated the dual broadband antenna of the present invention, including a spiral antenna 11 which may, for example, comprise a dual arm equi-angular or Archimedean spiral antenna structure of a planar configuration covering the opening in a cavity 12. This cavity may be defined by an open-ended metal cylinder 13 having a depth of the order of one-half wavelength of the average operating wavelength of the antenna. The spiral antenna 11 may, for example, have two spiral windings fed from the center by a balun 14 which may extend from the bottom center of the cavity as a coaxial cable 16. The cylinder 13 defining the cavity 12 is normally maintained at ground potential and a cylindrical balun ground shield 17 is disposed centrally of the cavity about the balun 14. The bottom of the cavity about the ground shield 17 may be filled with an RF absorbing material 18 which may, for example, take the form of carbon loaded dielectric or the like.

In addition to the relatively conventional spiral antenna structure described above, the present invention also incorporates in combination therewith a plurality of monopoles disposed within the chamber of orthogonal relationship to the spiral antenna. In the illustrated embodiment of the present invention, there are illustrated four monopoles 21, 22, 23 and 24 disposed orthogonally to the windings of the spiral antenna 11 and spaced 90° apart about the cavity beneath the spiral antenna. Each of the monopoles 21 to 24 comprises an electromagnetic radiator that may be physically formed as a metal plate or rod, such as the plate 26 of monopole 23. This plate 26, for example, is disposed perpendicularly to the plane of the spiral antenna 11 within the cavity beneath the antenna plane and directed radially of the cavity. The plate 26 extends from the vicinity of the outer wall of the cylinder 13 defining the cavity to the vicinity of the cylinder 17 defining the ground shield. At the inner end of each of the monopoles, these elements are resistively terminated by the provision of resistors 31 to 34 connecting the inner ends of the monopoles 21 to 24, respectively, to the ground plane 17. The monopoles 21 to 24 are adapted to be externally and independently energized and the monopole 23, for example, has the plate 26 thereof connected to a conductor 36 extending radially outward through an opening 37 in the cavity wall. Alternatively the monopoles can be fed at the center of the cavity and resistively loaded at the edges of the cavity.

Figure 4:
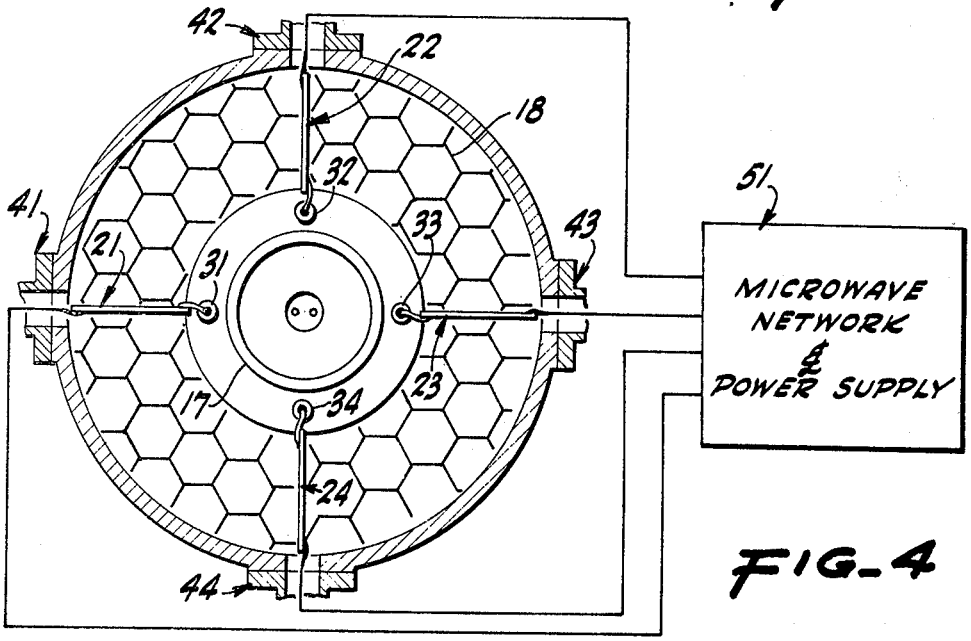
FIG. 4 is a sectional plan view taken in the plane 4—4 of FIG. 3.

As illustrated in FIGS. 1 and 4, coaxial cable connectors 41 to 44 are mounted on the exterior of the cavity cylinder 13 for electrical connection of the monopoles 21 to 24, respectively, with the lead wires or conductors extending from these monopoles as the center conductor of coaxial cables attached to the connectors. The monopoles are spaced 90° apart about the cavity and the plates of the monopoles are disposed perpendicularly to the plane of the spiral antenna immediately beneath such plane. The orthogonal relationship between monopoles and spiral antenna windings minimizes interaction between the two types of antennas. The monopoles are electrically connected through the coaxial couples 41 to 44 to a microwave network and power supply 51 in such a manner that the power applied to each monopole is equal and in phased progression of 0°, 90°, 180° and 270° in order to achieve circular antenna polarization. It is also possible to provide a lineally polarized antenna by feeding only two of the monopoles by a power divider. The spiral antenna windings are conventionally energized.

The embodiment of the present invention illustrated in the drawings thereof and described above has been tested over the range of 500 MHz to 18 GHz with excellent results. In such testing, the VSWR was less than 3:1 and the axial ratio was less than 3 decibels. The radiation pattern obtained by this embodiment of the present invention was the same as that obtained by the spiral antenna of the present invention without the monopole combination. It will thus be seen that the present invention provides for a material reduction in the low frequency cutoff of spiral antennas without increasing the physical size of same. This is highly advantageous particularly for aircraft mounted direction finding antennas.

Although the present invention has been described above in connection with a single preferred embodiment thereof, it will be appreciated that modifications and variations may be made within the spirit of the present invention and consequently it is not intended to limit the invention to the details of illustration or precise terms of description.

What is claimed is:

1. A dual mode broadband antenna comprising
a spiral antenna
means defining a cavity having an open end across which said spiral antenna is disposed,
electrical connections to said spiral antenna,
a plurality of monopoles disposed in said cavity behind said spiral antenna and in orthogonal relation to the windings of said spiral antenna, and
means for energizing said monopoles separately from said spiral antenna.

2. A dual mode broadband antenna comprising a spiral antenna, means defining a cavity having an open end across which the spiral antenna is disposed, electrical connections to said spiral antenna, a plurality of monopoles disposed radially of said cavity in orthogonal relation to the windings of said spiral antenna, electrical connections engaging the outer end of each monopole and a resistor connecting the inner end of each monopole to the means defining the cavity.

3. The antenna of claim 1 further defined by four of said monopoles being disposed radially in said cavity in equal spacing thereabout with each monopole being resistively loaded and adapted for equal power energization in phase sequence of 0°, 90°, 180° and 270°.

4. The antenna of claim 1 further defined by two of said monopoles being radially disposed in said cavity in 180° relation to each other with each monopole being resistively loaded and equally energized.

5. A dual mode broadband antenna of small physical size and broad frequency band comprising
means defining a cylindrical cavity having electrically grounded walls,
a spiral antenna mounted across the open end of said cavity in closing relation thereto,
electrical connections to said spiral antenna,
a plurality of monopole radiators disposed radially of said cavity beneath said spiral antenna in orthogonal relation to the windings of said spiral antenna,
resistors connecting the inner ends of each monopole radiator to the means defining said cavity, and
electrical connections to the outer ends of said monopole radiators.

6. The antenna of claim 5 further defined by four of said monopole radiators being disposed in said cavity and spaced equally thereabout for energization to produce with the energized spiral antenna circularly polarized radiation.

* * * * *